US010168122B1

(12) United States Patent
Cash et al.

(10) Patent No.: US 10,168,122 B1
(45) Date of Patent: Jan. 1, 2019

(54) CONCEALED CARRY HOLSTER

(71) Applicants: Frances Cash, Mazon, IL (US); Robert W. Cash, Mazon, IL (US)

(72) Inventors: Frances Cash, Mazon, IL (US); Robert W. Cash, Mazon, IL (US)

( * ) Notice: Subject to any disclaimer, the term of this patent is extended or adjusted under 35 U.S.C. 154(b) by 0 days.

(21) Appl. No.: 15/829,598

(22) Filed: Dec. 1, 2017

(51) Int. Cl.
*F41C 33/04* (2006.01)
*A41D 13/02* (2006.01)

(52) U.S. Cl.
CPC ..... *F41C 33/048* (2013.01); *A41D 13/02* (2013.01); *F41C 33/041* (2013.01)

(58) Field of Classification Search
CPC ..... F41C 33/048; F41C 33/041; A41D 13/02
See application file for complete search history.

(56) References Cited

U.S. PATENT DOCUMENTS 2,408,678 A * 10/1946 Paley ..... F41C 33/0209 224/250
3,347,299 A * 10/1967 Velda ..... A45C 3/06 150/106
4,235,356 A * 11/1980 Atchisson ..... F41C 33/0209 2/247
4,262,832 A * 4/1981 Perkins ..... A41D 1/04 2/102
4,294,385 A * 10/1981 Rogers ..... F41C 33/0236 224/182
4,408,706 A * 10/1983 Hurley ..... B26B 29/025 224/192
5,465,429 A * 11/1995 Rogers ..... F41C 33/0209 2/300
6,131,198 A * 10/2000 Westrick ..... F41C 33/0209 2/102
2006/0049224 A1* 3/2006 Lin ..... F41C 33/0209 224/198
2009/0025117 A1* 1/2009 French ..... A41D 27/20 2/69
2015/0089708 A1* 4/2015 Trevino ..... A41D 13/0012 2/69
2015/0144673 A1* 5/2015 Dahl ..... F41C 33/00 224/587
2015/0168100 A1* 6/2015 Hyde ..... F41C 33/06 206/317
2017/0211908 A1* 7/2017 Rocque ..... A41D 1/02
2017/0234647 A1* 8/2017 Schweitzer ..... F41C 33/0209 224/587

* cited by examiner

*Primary Examiner* — Corey Skurdal
(74) *Attorney, Agent, or Firm* — Foley & Lardner LLP

(57) ABSTRACT

A holster includes a first panel and a second panel fixedly attached to the first panel so as to define a receptacle for receiving a firearm. A plurality of first fasteners are fixedly coupled to at least one of the first and second panels. The plurality of first fasteners are structured to engage a corresponding plurality of second fasteners on an inside surface of a bib of a pair of bib overalls so as to removably couple the holster to the bib.

16 Claims, 4 Drawing Sheets

CONCEALED CARRY HOLSTER

BACKGROUND

Concealed carry refers to the practice of carrying a handgun or other weapon in public in a concealed or hidden manner, either on one's person or in close proximity thereto. In some countries and jurisdictions, civilians and off-duty police officers are legally able to carry concealed handguns. In fact, in some jurisdictions, the only legal way for a civilian to carry a handgun is for it to be concealed.

A concealed carry holster is a holster designed to be used for concealed carry such that the holster is hidden. Concealed carry holsters are typically structured to be worn by an individual on a belt at the waist, on the thigh, under an arm, or around an ankle.

SUMMARY

Various embodiments relate to a holster. An example holster includes a first panel and a second panel fixedly attached to the first panel so as to define a receptacle for receiving a firearm. A plurality of first fasteners are fixedly coupled to at least one of the first and second panels. The plurality of first fasteners are structured to engage a corresponding plurality of second fasteners on an inside surface of a bib of a pair of bib overalls so as to removably couple the holster to the bib.

Another example holster includes a first panel and a second panel fixedly attached to the first panel so as to define a receptacle for receiving a firearm, and so as to define an opening for accessing the receptacle. A plurality of first fasteners is fixedly coupled to at least one of the first and second panels. The plurality of first fasteners are structured to engage a corresponding plurality of second fasteners on an inside surface of a garment so as to removably couple the holster to the garment. The second fasteners are positioned so that the opening is oriented (1) parallel to a vertical axis defined by the garment as intended to be worn by an individual or (2) downward at an angle relative to the vertical axis.

Various other embodiments relate to a concealed carry holster system. An example concealed carry holster system includes a pair of bib overalls including a bib. A plurality of first fasteners are fixedly coupled to an inside surface of the bib. A holster is structured to be removably coupled to an inside surface of the bib. The holster includes a first panel and a second panel fixedly attached to the first panel so as to define a receptacle for receiving a firearm, and so as to define an opening for accessing the receptacle. A plurality of second fasteners are fixedly coupled to at least one of the first and second panels. The plurality of second fasteners are structured to engage the plurality of first fasteners so as to removably couple the holster to the bib.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below.

Other features, aspects, and advantages of the disclosure will become apparent from the description, the drawings, and the claims.

Figure 1:
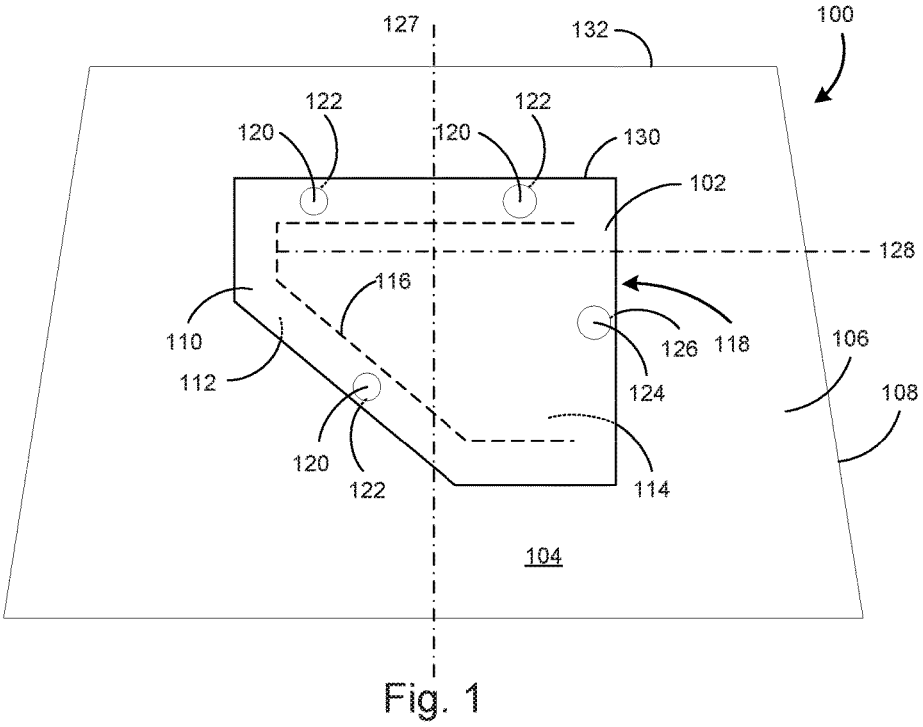
FIG. 1 is a front view of a concealed carry holster system, according to an embodiment.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Various embodiments relate to a concealed carry holster system. The concealed carry holster system includes a holster structured to be removably coupled to a garment. In some embodiments, the holster is structured to be removably coupled to an inside surface of a bib of a pair of bib overalls. A single garment for an individual is referred to herein in the plural, as commonly used in the industry, e.g., overalls are referred to as a pair of overalls.

In one embodiment, the holster includes a first panel and a second panel fixedly attached to the first panel so as to define a receptacle for receiving a firearm. The first and second panels also define an opening for accessing the receptacle. A plurality of first fasteners are fixedly coupled to at least one of the first and second panels. The plurality of first fasteners are structured to engage a corresponding plurality of second fasteners on an inside surface of a bib of a pair of bib overalls so as to removably couple the holster to the bib. The holster is detachable from the bib without having to first remove the firearm from the holster. Accordingly, the holster is also structured to function as a case for the firearm when the holster is detached from the bib.

In various embodiments, the holster is structured to be positioned in a particular orientation relative to the bib. The position of the holster relative to the bib is defined by the positions of the plurality of first and second fasteners. In some embodiments, the positions of the first fasteners on the holster are fixed, so the position of the holster relative to the bib is defined by the positions of the second fasteners on the bib. The bib of bib overalls is structured to be in a particular orientation relative to an individual wearing the bib overalls in their intended manner. Accordingly, the holster is also structured to be positioned in a particular orientation relative to an individual wearing the bib overalls.

In some embodiments, the holster is specifically designed to be detachably coupled to bib overalls so as to provide various technical advantages to solve problems exhibited by conventional holsters. One problem with conventional holsters is that water, dirt, or debris may enter the holster through its opening because the opening is configured to face upwards when worn by an individual. Conventional holsters are configured to be worn by an individual on a belt at the waist, on the thigh, under an arm, or around an ankle. The orientation of a conventional holster, as a result of the intended position of the holster on an individual's body, requires that the opening of the holster faces upwards. In contrast, the opening of the instant holster is oriented horizontally (transverse) or at a downward angle relative to an individual wearing the bib overalls. Such orientations are uniquely possible due to the structure of the detachable coupling of the holster to the bib of bib overalls and, accordingly, due to the position of the bib being towards the top of an individual's body. By orienting the opening of the holster horizontally or at a downward angle, water, dust, and debris are less likely to enter the holster through the opening and potentially damage the firearm than in conventional holsters in which the opening is oriented upwards, such as those structured to be worn by an individual on a belt at the waist, on the thigh, under an arm, or around an ankle.

Another technical advantage of the instant holster is that it is wearable with bib overalls, whereas many other holsters are not. For example, bib overalls have straps to hold the bib overalls up on an individual's body. The straps obviate the need to wear a belt, as with conventional pants. Accordingly, belt holsters are not amenable for use with bib overalls. Concealed carry leg or thigh holsters configured to be worn underneath pants are also not amenable for use with bib overalls because bib overalls do not have a waist opening or a skirt or dress opening that an individual can reach into to access the holster. Accordingly, the instant holster, which in some embodiments is structured specifically for attachment to a bib of bib overalls, enables individuals wearing bib overalls to concealed carry.

Alternatively, suspenders, shoulder strapped back supports, or similar articles of clothing and/or accessories, can be used in place of bib overalls for use with certain embodiments of the instant holster. Further, in certain embodiments, the instant holster is configured to engage with articles of clothing that provide a structure similar to the bib of bib overalls, such as shirts or coats with a high-positioned pocket, for example, a pull-over garment with a chest-height central pocket area.

Another technical advantage of the instant holster is its improved ease of accessibility relative to conventional holsters. The bib of bib overalls is open on its left and right sides. Therefore, an individual has unobstructed access to a space between the individual's chest and the bib via the left and right sides of the bib. Accordingly, the instant holster is accessible by an individual without requiring the individual to first move a portion of clothing. In contrast, access to conventional holsters requires an individual to first move a jacket or pant leg. Therefore, the instant holster is accessible faster and with less movement required than by conventional holsters.

Another technical advantage of the instant holster is that it enables a shorter draw relative to conventional holsters due to its intended position on the bib of bib overalls. Firearms, such as pistols, are intended to be held at or slightly above chest level for shooting. The bib of bib overalls is structured to be positioned on an individual's chest. Accordingly, an individual does not have to substantially change the height of the firearm when moving the firearm from the holster to a shooting position. In contrast, conventional holsters, such as belt or ankle holsters, require an individual to move the firearm a substantial distance from the holster to a shooting position. Accordingly, the instant holster enables a quicker and more efficient draw than conventional holsters.

FIG. 1 is a front view of a concealed carry holster system 100, according to an embodiment. The concealed carry holster system 100 includes a holster 102 removably coupled to an inside surface 104 of a bib 106 of a pair of bib overalls. The holster 102 is structured to receive a firearm (e.g., a pistol). When the holster 102 is coupled to the bib 106, the firearm is concealed from other individuals, but is easily accessible to an individual wearing the bib overalls by reaching from a first side 108 of the bib 106 between the inside surface 104 and the individual's body to access the firearm from the holster 102.

The holster 102 includes a first panel 110 fixedly attached to a second panel 112 so as to define a receptacle 114 for receiving a firearm. In some embodiments, the first and second panels 110, 112 are stitched together via stitching 116. The first and second panels 110 define an opening 118 for accessing the receptacle 114. For example, the stitching 116 coupling the first and second panels 110, 112 extends proximate a perimeter of the first and second panels 110, 112, except for along the opening 118.

In some embodiments, the first and second panels 110, 112 are made of a fabric, such as a coated nylon fabric. For example, in one embodiment, the first and second panels 110, 112 are made of a urethane-coated nylon. In some embodiments, the urethane-coated nylon has a weight of at least 1000 Denier. In other embodiments, the first and second panels 110, 112 are made of leather or of another type of material.

In some embodiments, the first and second panels 110, 112 are lined with another type of fabric on the respective sides defining the receptacle 114. For example, according to various embodiments, the first and second panels 110, 112 are lined with cotton or another type of fabric that will not scratch or otherwise damage the firearm and that will keep the firearm free of dust and dirt. To this end, it should be appreciated that the holster 102 may include stitching in addition to the stitching 116 that couples the first and second panels 110, 112 and defines the receptacle 114 to couple the liner material to each of the first and second panels 110, 112.

The holster 102 also includes a plurality of first fasteners 120 fixedly coupled to at least one of the first and second panels 110, 112. A plurality of second fasteners 122 are fixedly coupled to the bib 106 of the bib overalls. The plurality of second fasteners 122 are positioned so as to be covered by one or more pockets attached to an outside surface of the bib 106, which is opposite the inside surface 104. Accordingly, the plurality of second fasteners 122 are concealed from other individuals so that other individuals cannot tell that the individual wearing the bib overalls has the holster 102 attached thereto. The plurality of first fasteners 120 are structured to engage the plurality of second fasteners 122 on the inside surface 104 of the bib 106 so as to removably couple the holster 102 to the bib 106. Accordingly, the holster 102 may be decoupled from the bib 106 without having to first remove the firearm from the holster 102. Therefore, the holster 102 is also structured to be used as a firearm case when detached from the bib 106.

In some embodiments, the plurality of first and second fasteners 120, 122 are snap devices. For example, in an embodiment, the plurality of first fasteners 120 are female snap devices, and the plurality of second fasteners 122 are male snap devices structured to engage the female snap devices. In an alternative embodiment, the plurality of first fasteners 120 are male snap devices, and the plurality of second fasteners 122 are female snap devices. In some embodiments, the plurality of first fasteners 120 are riveted through the first and second panels 110, 112 of the holster.

Similarly, the plurality of second fasteners 122 are riveted through the bib 106. In other embodiments, the plurality of first and second fasteners 120, 122 are fabric hook-and-loop (e.g., Velcro®) fasteners or other types of detachable fasteners.

The holster 102 also includes third and fourth fasteners 124, 126 positioned proximate the opening 118. In one embodiment, the third fastener 124 is coupled to the first panel 110, and the fourth fastener 126 is coupled to the second panel 112. The third and fourth fasteners 124, 126 are removably engageable with one another so as to secure the opening 118 in a closed configuration. In some embodiments, the third and fourth fasteners 124, 126 are snap devices. For example, in an embodiment, the third fastener 124 is a female snap device, and the fourth fastener 126 is a male snap device structured to engage the female snap device. In an alternative embodiment, the third fastener 124 is a male snap device, and the fourth fastener 126 is a female snap device. In some embodiments, the third fastener 124 is riveted through the first panel 110 of the holster 102. Similarly, the fourth fastener 126 is riveted through the second panel 112 of the holster 102. In other embodiments, the third and fourth fasteners 124, 126 are fabric hook-and-loop (e.g., Velcro®) fasteners of other types of detachable fasteners.

The opening 118 defines a firearm insertion axis 128. The firearm insertion axis 128 is an axis along which a firearm is generally moved to insert the firearm into the receptacle 114 of the holster 102. In some embodiments, the firearm insertion axis 128 is parallel to a top edge 130 of the holster 102. In some embodiments, the firearm insertion axis 128 is structured to be coaxial to or parallel with a central axis of a barrel of a firearm positioned in the receptacle 114. In the embodiment illustrated in FIG. 1, the firearm insertion axis 128 is generally parallel with a top edge 132 of the bib 106.

Figure 2:
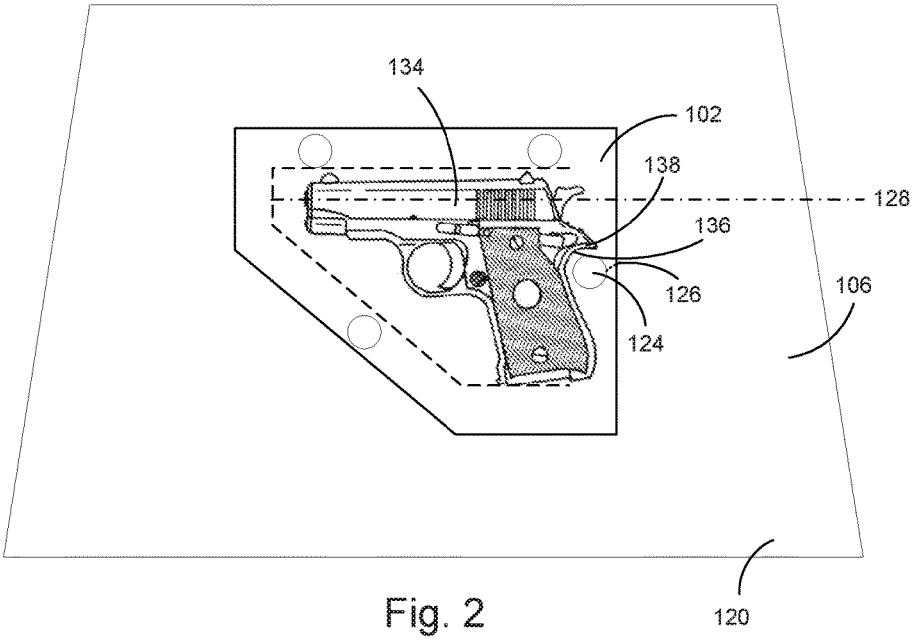
FIG. 2 is a front view of the concealed carry holster system of FIG. 1, with the first panel hidden.

FIG. 2 is a front view of the concealed carry holster system 100 of FIG. 1, with the first panel 110 hidden. FIG. 2 illustrates an arrangement of a firearm 134 positioned in the receptacle 114 of the holster 102. In some embodiments, the firearm 134 is a firearm structured to shoot .380 Automatic Colt Pistol ("ACP") ammunition. In other embodiments, the firearm 134 is structured to shoot other types of ammunition. In one embodiment, the firearm 134 is a semi-automatic automatic pistol. In one embodiment, the firearm 134 is a 1911-style pistol. In other embodiments, the firearm 134 is a different type of compact or sub-compact pistol. In some embodiments, the firearm 134 is a revolver.

As illustrated in FIG. 2, in some embodiments, the third and fourth fasteners 124, 126 are positioned so as to be adjacent a grip safety 136 of the firearm 134 positioned in the receptacle 114. In some embodiments, the third and fourth fasteners 124, 126 are positioned so that a beavertail 138 of the grip safety 136 extends at least partially over the third and fourth fasteners 124, 126. The third and fourth fasteners 124, 126, positioned on the holster 102 in the particular configuration mentioned above, operate to retain the firearm 134 within the holster 102 securely and without the firearm 134 shifting or moving within the holster 102. At the same time, an individual can easily decouple (e.g., unsnap) the third and fourth fasteners 124, 126 to retrieve the firearm 134 from the receptacle. This feature is particularly useful for individuals who may wear overalls, such as farmers, locomotive engineers, and tradesmen, who are subject to vibration or force while working. The instant holster 102 securely retains the firearm within the holster 102 even when subject to substantial vibration or movement, during which firearms in conventional holsters may become dislodged.

Figure 3:
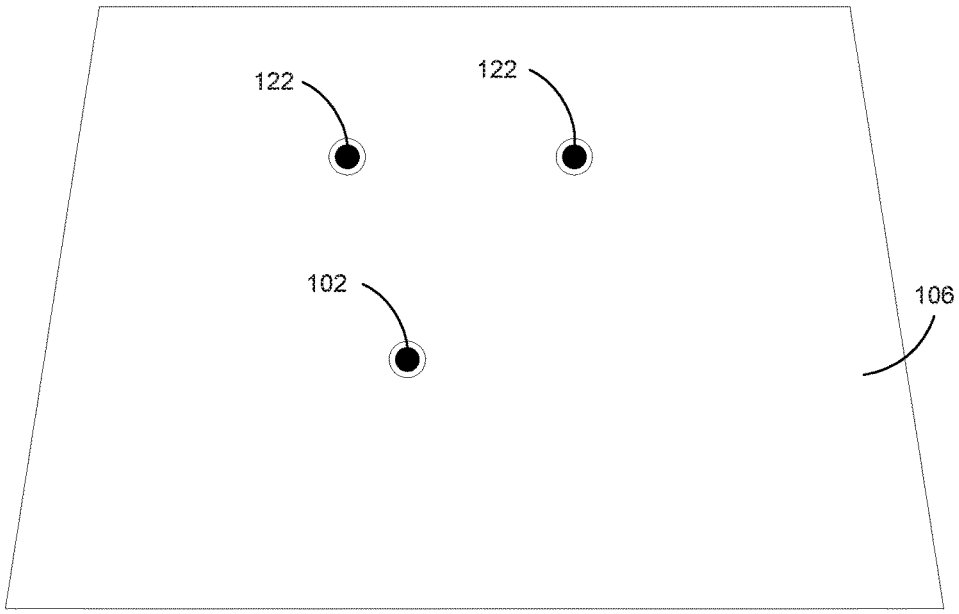
FIG. 3 is a front view of the bib of FIGS. 1 and 2, with the holster detached therefrom.

FIG. 3 is a front view of the bib 106 of FIGS. 1 and 2, with the holster 102 detached therefrom. The plurality of second fasteners 122 are clearly shown in FIG. 3 with the holster removed. As shown in FIG. 3, the plurality of second fasteners 122 are male snap devices.

Figure 4:
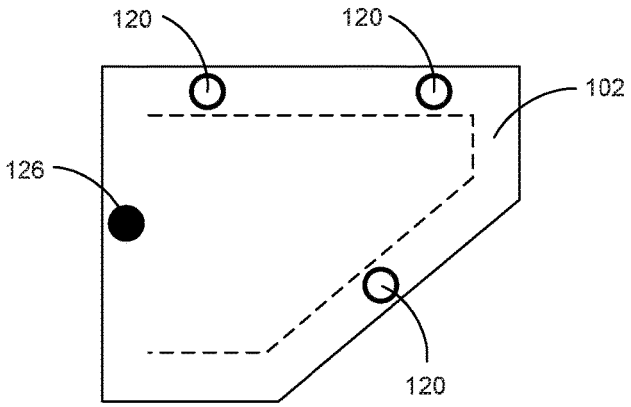
FIG. 4 is a rear view of the holster of FIGS. 1 and 2, detached from the bib.

FIG. 4 is a rear view of the holster 102 of FIGS. 1 and 2, detached from the bib 106. FIG. 4 clearly shows the plurality of first fasteners 120 from a rear side of the holster 102. As shown in FIG. 4, the plurality of first fasteners 120 are female snap devices. In some instances, it is preferable for the plurality of first fasteners 120 to be female, rather than male, snap devices. Female snap devices typically have a lower profile than corresponding male fasteners because the male engagement feature of male snap devices projects outward from the snap devices. Male snap devices may be more likely to scratch a surface than female snap devices. Accordingly, embodiments in which the plurality of first fasteners 120 are female snap devices provide technical advantages over those embodiments in which the plurality of first fasteners are male snap devices.

The fourth fastener 126 is also shown in FIG. 4. It should be appreciated that the portion of the fourth fastener 126 visible in FIG. 4 is a back rivet side of the fourth fastener 126. The third and fourth fasteners 126 are structured to secure the opening 118 in a closed position and are not structured to secure the holster 102 to the bib 106.

Figure 5:
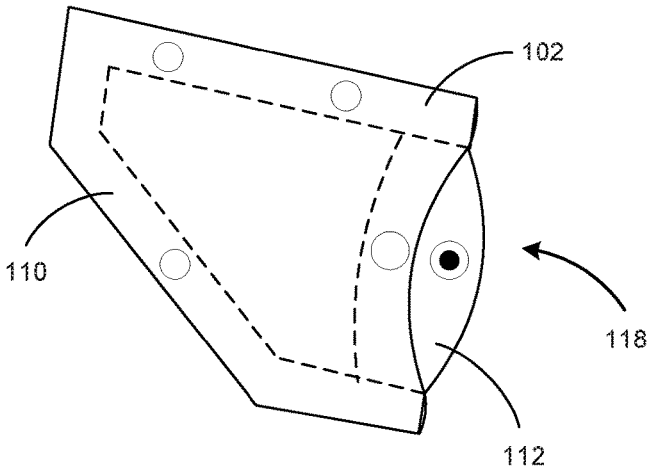
FIG. 5 is a perspective view of the holster of FIGS. 1, 2, and 4.

FIG. 5 is a perspective view of the holster 102 of FIGS. 1, 2, and 4. As shown in FIG. 5, the first and second panels 110, 112 define the opening 118. FIG. 5 illustrates the holster 102 detached from the bib 106 and in an open position, with the third and fourth fasteners 124, 126 decoupled from one another.

Figure 6:
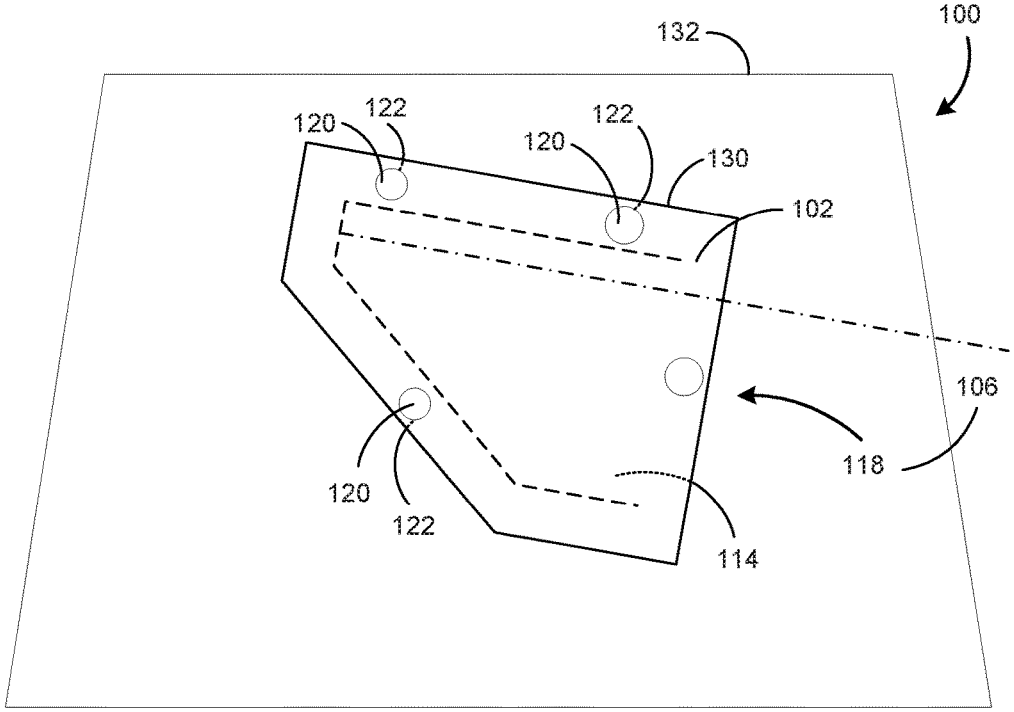
FIG. 6 is a front view of a concealed carry holster system, according to another embodiment.

FIG. 6 is a front view of a concealed carry holster system 600, according to another embodiment. The concealed carry holster system 600 includes the holster 102 and the bib 106 of the concealed carry holster system 100 of FIG. 1. However, in the concealed carry holster system 600 of FIG. 6, the plurality of first and/or second fasteners 120, 122 are positioned so that the opening is oriented at an angle away from the top edge 132 of the bib 106. In other words, the opening 118 faces downwards. In some embodiments, the plurality of first fasteners 120 are positioned on the holster 102 in the same orientation as in the concealed carry holster system 100. However, the plurality of second fasteners 122 are positioned on the bib 106 so that the opening 118 is oriented at an angle away from the top edge of the bib 106. Put another way, the plurality of first and/or second fasteners 120, 122 are positioned on the bib 106 so that the firearm insertion axis 128 extends in a downward direction from the opening 118 relative to a first axis defined by the top edge 132 of the bib 106. Put still another way, the firearm insertion axis 128 is rotated relative to the first axis at an angle between zero and forty-five degrees in a clockwise direction with respect to the inside surface 104 of the bib 106.

In contrast, the plurality of first and second fasteners 120, 122 of the concealed carry holster system 100 are oriented so that the opening 118 is perpendicular to the top edge 132 of the bib 106. Put another way, the plurality of first and second fasteners 120, 122 of the concealed carry holster system 100 are oriented so that the firearm insertion axis 128 is parallel with the first axis defined by the top edge 132 of the bib 106.

Figure 7:
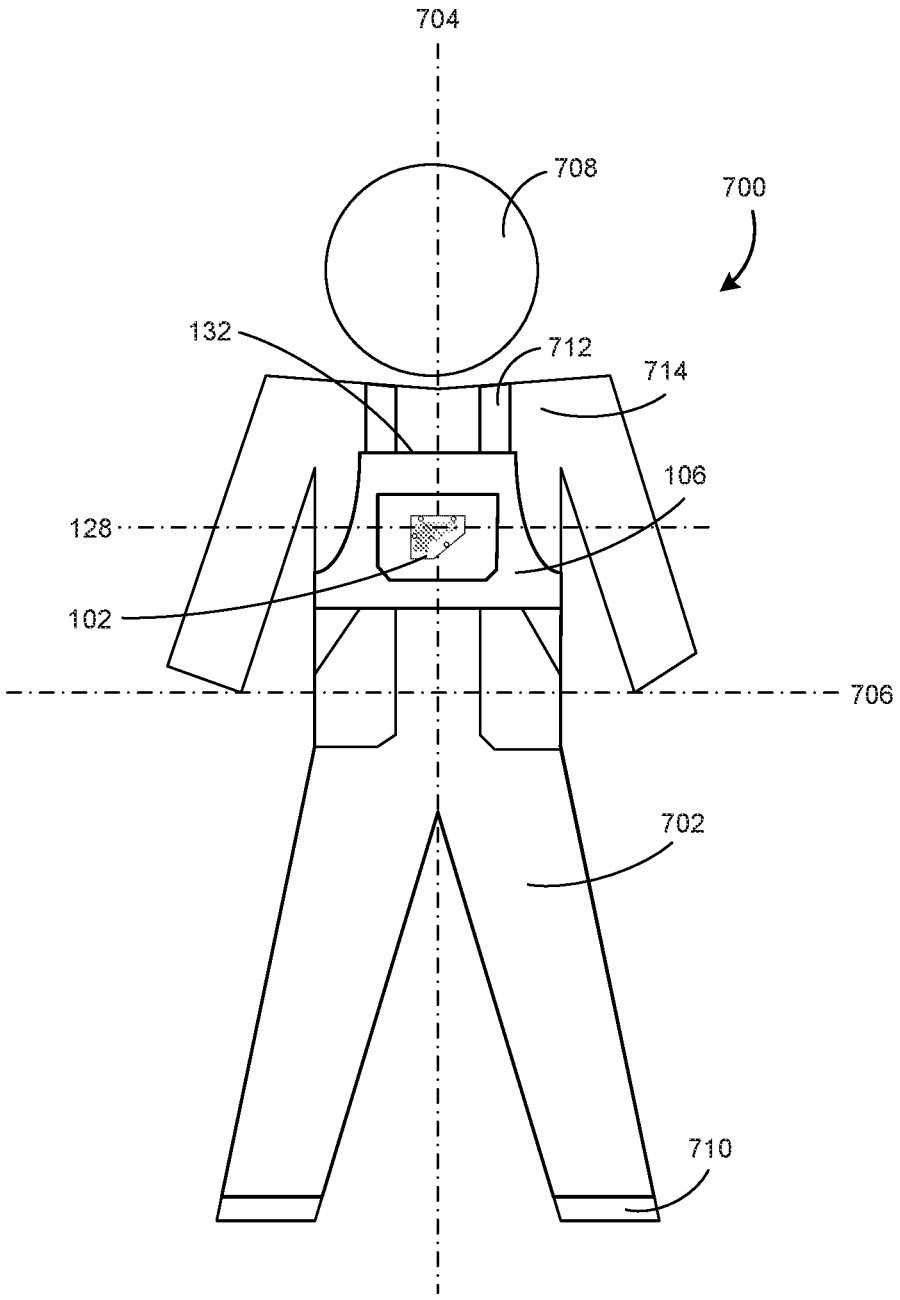
FIG. 7 is a front view of an individual wearing bib overalls including the bib and the holster of FIGS. 1-5.

FIG. 7 is a front view of an individual 700 wearing bib overalls 702 including the bib 106 and the holster 102 of FIGS. 1-5. As illustrated in FIG. 7, the individual 700 defines a vertical axis 704 and a transverse axis 706. The vertical axis 704 extends along a longest dimension of the individual 700. In other words, the vertical axis 704 extends from head 708 to feet 710 of the individual 700 and through a centroid of the individual 700. The transverse axis 706 is perpendicular to the vertical axis 704. In anatomical terms, the vertical axis 704 can be defined as a craniocaudal or longitudinal axis. The transverse axis 706 can be defined as a left-right, horizontal, or frontal axis.

The bib overalls 702 are structured to be worn in a particular orientation relative to the individual 700. For example, the bib overalls 702 include straps 712 that extend around shoulders 714 of the individual 700 and that are removably coupled to the bib 106 so as to retain the bib overalls 702 on the individual 700. The straps 712 are structured to hold the bib 106 so that the top edge 132 of the bib 106 is parallel to the transverse axis 706 of the individual 700, as defined with regard to an intended orientation of the bib overalls 702 as worn by the individual 700. It should be appreciated that the straps 712 hold up the bib overalls 702 on the individual 700 without requiring use of a belt, as with conventional pants.

The position of each of the bib 106, the holster 102, and the firearm insertion axis 128 can be described relative to an intended orientation of an individual wearing the bib overalls 702 including the bib 106 and the holster 102 attached thereto. In other terms, the position of each of the bib 106, the holster 102, and the firearm insertion axis 128 can be described relative to an intended orientation the bib overalls 702 on an individual (e.g., the individual 700), with the bib overalls 702 including the bib 106 and the holster 102 attached thereto. It should be understood that the terms "upward" and "downward," as used herein, refer to the intended orientation of the bib 106 and the holster 102 as worn by the individual. The term "upward" refers to a first direction from the holster 102 to the head 708 of the individual 300 along the vertical axis 704. The term "downward" refers to a second direction from the holster 102 to the feet 710 of the individual 300 along the vertical axis 704.

In some embodiments, as illustrated in FIG. 7, the holster 102 is positioned on the bib overalls 702 so that the firearm insertion axis 128 is parallel to the transverse axis 706 of the individual 700. In some embodiments, the holster 102 is positioned on the bib overalls 702 so that the firearm insertion axis 128 is angled relative to the transverse axis 706 of the individual 700, with the opening 118 facing away from the top edge 132 of the bib 106 (e.g., the opening 118 facing downwards). Put another way, in some embodiments, the holster 102 is positioned on the bib overalls 702 so that the firearm insertion axis 128 is angled relative to the transverse axis 706 of the individual 700, with the opening 118 facing the feet 710 of the individual 700 wearing the bib overalls 702.

It should be understood that no claim element herein is to be construed under the provisions of 35 U.S.C. § 112(f), unless the element is expressly recited using the phrase "means for." The schematic flow chart diagrams and method schematic diagrams described above are generally set forth as logical flow chart diagrams. As such, the depicted order and labeled steps are indicative of representative embodiments. Other steps, orderings and methods may be conceived that are equivalent in function, logic, or effect to one or more steps, or portions thereof, of the methods illustrated in the schematic diagrams. Further, reference throughout this specification to "one embodiment," "an embodiment," "an example embodiment," or similar language means that a particular feature, structure, or characteristic described in connection with the embodiment is included in at least one embodiment of the present invention. Thus, appearances of the phrases "in one embodiment," "in an embodiment," "in an example embodiment," and similar language throughout this specification may, but do not necessarily, all refer to the same embodiment.

Accordingly, the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A concealed carry holster system, comprising:
- a pair of bib overalls, comprising:
  - a trouser portion;
  - a bib fixedly coupled to a front, top edge of the trouser portion, a top edge of the bib defining a first axis; and
  - a plurality of straps, each of the plurality of straps comprising:
    - a first end fixedly coupled to a rear, top edge of the trouser portion, and
    - a second end removably coupled to the bib to support the pair of bib overalls on shoulders of an individual;
- a plurality of first fasteners fixedly coupled to an inside surface of the bib; and
- a holster removably coupled to the inside surface of the bib, the holster comprising:
  - a first panel;
  - a second panel fixedly attached to the first panel so as to define a receptacle for receiving a firearm, and so as to define an opening for accessing the receptacle, the opening defining a firearm insertion axis; and
  - a plurality of second fasteners fixedly coupled to at least one of the first and second panels, the plurality of first fasteners engaged to the plurality of second fasteners so as to removably couple the holster to the bib, the plurality of second fasteners positioned so that the firearm insertion axis extends in a downward direction from the opening relative to the first axis.

2. The system of claim 1,
- wherein the plurality of second fasteners are positioned so that the opening faces downward relative to a transverse axis of the individual wearing the pair of bib overalls.

3. The system of claim 1, wherein the bib is positioned in front of a chest of the individual when the second end of each of the plurality of straps is coupled to the bib.

4. The system of claim 1, further comprising:
- a third fastener fixedly coupled to the first panel proximate the opening; and
- a fourth fastener fixedly coupled to the second panel proximate the opening, the third and fourth fasteners removably engageable with one another so as to secure the opening in a closed configuration.

5. The system of claim 4, wherein the third and fourth fasteners are positioned so as to retain the firearm in the holster when the third and fourth fasteners are coupled to each other.

6. The system of claim 4, wherein the third and fourth fasteners are positioned so that a beavertail of a grip safety of the firearm extends at least partially over the third and fourth fasteners.

7. The system of claim 1, wherein the plurality of first fasteners are male snap devices, and wherein the plurality of second fasteners are female snap devices removably engageable with the male snap devices.

8. The system of claim 1, wherein the plurality of first and second fasteners are fabric hook-and-loop fasteners.

9. A concealed carry holster system, comprising:

a pair of bib overalls, comprising:

a trouser portion;

a bib fixedly coupled to a front, top edge of the trouser portion, a top edge of the bib defining a first axis; and a plurality of straps, each of the plurality of straps comprising:

a first end fixedly coupled to a rear, top edge of the trouser portion, and a second end removably coupled to the bib to support the pair of bib overalls on shoulders of an individual;

a plurality of first fasteners fixedly coupled to an inside surface of the bib; and a holster removably coupled to the inside surface of the bib, the holster comprising:

a first panel;

a second panel fixedly attached to the first panel so as to define a receptacle for receiving a firearm, and so as to define an opening for accessing the receptacle, the opening defining a firearm insertion axis; and a plurality of second fasteners fixedly coupled to at least one of the first and second panels, the plurality of first fasteners engaged to the plurality of second fasteners so as to removably couple the holster to the bib, the plurality of second fasteners positioned so that the firearm insertion axis is parallel to the first axis.

10. The system of claim 9, wherein the plurality of second fasteners are positioned so that the opening faces downward relative to a transverse axis of the individual wearing the pair of bib overalls.

11. The system of claim 9, wherein the bib is positioned in front of a chest of the individual when the second end of each of the plurality of straps is coupled to the bib.

12. The system of claim 9, further comprising:

a third fastener fixedly coupled to the first panel proximate the opening; and a fourth fastener fixedly coupled to the second panel proximate the opening, the third and fourth fasteners removably engageable with one another so as to secure the opening in a closed configuration.

13. The system of claim 12, wherein the third and fourth fasteners are positioned so as to retain the firearm in the holster when the third and fourth fasteners are coupled to each other.

14. The system of claim 12, wherein the third and fourth fasteners are positioned so that a beavertail of a grip safety of the firearm extends at least partially over the third and fourth fasteners.

15. The system of claim 9, wherein the plurality of first fasteners are male snap devices, and wherein the plurality of second fasteners are female snap devices removably engageable with the male snap devices.

16. The system of claim 9, wherein the plurality of first and second fasteners are fabric hook-and-loop fasteners.

* * * * *